US008974860B2

(12) United States Patent
Hamilton et al.

(10) Patent No.: US 8,974,860 B2
(45) Date of Patent: Mar. 10, 2015

(54) SELECTIVE DEPOSITION OF METAL ON PLASTIC SUBSTRATES

(76) Inventors: Robert Hamilton, Torrington, CT (US); Mark Wojtaszek, Canton, CT (US)

( * ) Notice: Subject to any disclaimer, the term of this patent is extended or adjusted under 35 U.S.C. 154(b) by 1139 days.

(21) Appl. No.: 12/488,158

(22) Filed: Jun. 19, 2009

(65) Prior Publication Data

US 2010/0323109 A1 Dec. 23, 2010

(51) Int. Cl.

| | |
|---|---|
| ***C23C 18/30*** | (2006.01) |
| ***C23C 18/32*** | (2006.01) |
| ***C23C 18/38*** | (2006.01) |
| ***C23C 18/16*** | (2006.01) |
| ***C23C 18/20*** | (2006.01) |
| ***C23C 18/36*** | (2006.01) |
| ***C23C 18/40*** | (2006.01) |

(52) U.S. Cl.

CPC ..... *C23C 18/1607* (2013.01); *C23C 18/1608* (2013.01); *C23C 18/2046* (2013.01); *C23C 18/30* (2013.01); *C23C 18/1641* (2013.01); *C23C 18/1653* (2013.01); *C23C 18/166* (2013.01); *C23C 18/2086* (2013.01); *C23C 18/36* (2013.01); *C23C 18/40* (2013.01)

USPC ..... 427/306; 427/443.1

(58) Field of Classification Search

CPC ..... C23C 18/1608

USPC ..... 427/306

See application file for complete search history.

(56) References Cited

U.S. PATENT DOCUMENTS

| | | | | |
|---|---|---|---|---|
| 3,443,988 | A * | 5/1969 | McCormack et al. | 428/209 |
| 3,556,955 | A * | 1/1971 | Ancker et al. | 205/167 |
| 3,640,789 | A * | 2/1972 | Hepfer | 156/92 |
| 4,039,714 | A * | 8/1977 | Roubal et al. | 428/336 |
| 4,520,046 | A * | 5/1985 | McCaskie et al. | 427/304 |
| 4,592,929 | A | 6/1986 | Tubergen et al. | |
| 4,610,895 | A | 9/1986 | Tubergen et al. | |
| 4,782,007 | A * | 11/1988 | Ferrier | 430/313 |
| 5,168,624 | A | 12/1992 | Shirai | |
| 5,192,590 | A | 3/1993 | Sherman | |
| 5,246,507 | A | 9/1993 | Kodama et al. | |
| 5,407,622 | A * | 4/1995 | Cleveland et al. | 264/104 |
| 5,510,216 | A | 4/1996 | Calabrese et al. | |
| 5,759,708 | A * | 6/1998 | Tarasevich et al. | 428/689 |
| 5,958,509 | A | 9/1999 | Neumann et al. | |
| 6,137,452 | A | 10/2000 | Sullivan | |
| 6,468,672 | B1 | 10/2002 | Donovan, III et al. | |
| 6,601,296 | B1 | 8/2003 | Dailey et al. | |
| 6,814,584 | B2 | 11/2004 | Zaderej | |
| 7,189,120 | B2 | 3/2007 | Zaderej | |
| 7,394,425 | B2 | 7/2008 | Luch | |
| 2004/0239836 | A1 | 12/2004 | Chase | |
| 2009/0004465 | A1 | 1/2009 | Kano et al. | |

OTHER PUBLICATIONS

Kaneko et al., Study of Sulfonation Mechanism of Low-Density Polyethylene Films with Fuming Sulfuric Acid, Journal of Applied Polymer Science, vol. 91, 2435-2442, 2004.

Skelly, Design Fundamentals—Meeting the Shielding Challenges of Injection-Molded Plastics, Dec. 1, 2008, www.conformity.com.

* cited by examiner

*Primary Examiner* — Katherine A Bareford

(74) *Attorney, Agent, or Firm* — Carmody Torrance Sandak & Hennessey LLP

(57) ABSTRACT

The present invention relates to a method of selectively plating a plastic article comprising a first polymer resin portion and a second polymer resin portion, wherein said first polymer resin portion is not rendered plateable by sulfonation and said second polymer resin portion is rendered plateable by sulfonation. The method comprises the steps of sulfonating the plastic article, activating the sulfonated plastic article to accept plating thereon, and plating the sulfonated and activated article in an electroless plating bath. The plastic article is selectively plated such that the first polymer resin portion does not have plating thereon and the second polymer resin portion is electrolessly plated.

8 Claims, No Drawings

SELECTIVE DEPOSITION OF METAL ON PLASTIC SUBSTRATES

FIELD OF THE INVENTION

The present invention relates generally to the selective deposition of metal on plastic substrates.

BACKGROUND OF THE INVENTION

Molded-one piece articles are used, for example in forming printed circuit boards. In many instances, two separate molding steps are used to form two portions of the article. For example, two-shot molding is a means of producing devices having two portions, with each portion made from a different injection molded polymer. The process is also used for producing two-colored molded plastic articles and for combining hard and soft plastics in one molded part.

A typical two-shot molding process includes the following steps:

1. Mold first shot;
2. Overmold first shot with second polymer;
3. Etch and activate exposed areas; and
4. Plate with electroless nickel and/or electroless copper to deposit plating material.

In addition to possessing the required end use properties for the product, the two polymers selected for use must be compatible in the two-shot molding process and must also provide suitable surfaces for plating. In order to plate one of the polymers and not the other, it has generally been found necessary to either selectively activate the polymer to be plated after the molding process or to use a polymer having a catalyst disposed therein, i.e., a polymer containing a certain percentage of palladium, as described for example in U.S. Pat. No. 7,189,120 to Zaderej, the subject matter of which is herein incorporated by reference in its entirety. Other examples of two-shot (or multi-shot) molding processes are described in U.S. Pat. No. 5,407,622 to Cleveland et al. and in U.S. Pat. No. 6,601,296 to Dailey et al., the subject matter of each of which is herein incorporated by reference in its entirety. Still other processes that have been suggested include (i) embedding a catalyst in all of the plastic and then selectively exposing it and activating it by means of selective laser ablation, (ii) the use of double-shot molding wherein one shot contains catalytic poisons to prevent plating in that area and, (iii) double shot (or multiple-shot) molding, wherein the plastic in the plateable shot is easily etched to form a surface conducive to catalyzation and plating and the unplateable shot is not easily etched.

Typical plastic materials that can be made conducive to catalyzation and plating include acrylonitrile-butadiene-styrene (ABS) resins, polyolefins, polyvinyl chloride, polycarbonate-acrylonitrile-butadiene-styrene (PC/ABS) resins, and phenol formaldehyde resins, among others.

The process for forming an electroless coating (plating on plastics cycle) typically involves the steps of (1) etching the substrate; (2) neutralizing the etched surface; (3) catalyzing the neutralized surface in a solution that contains palladium chloride, stannous chloride and hydrochloric acid, or an acidic solution of ionic palladium, followed by (4) immersion in an accelerator solution, which is either an acid or a base; and (4) forming a metallic coating on the activated substrate. The surface of the substrate is generally etched by dipping the substrate in an etchant, which is typically a mixed solution of chromic acid and sulfuric acid. The metallic coating may be deposited on the activated substrate by immersing the substrate in a chemical plating bath containing nickel or copper ions and depositing the metal thereon from the bath by means of the chemical reduction of the metallic ions (i.e., electroless plating). The resulting metal coating is useful for subsequent electroplating because of its electrical conductivity. It is also generally desirable to wash the substrate with water after each of the above steps.

This method has two major drawbacks:

(1) The conventional and lowest cost materials for this process are acrylonitrile-butadiene-styrene (ABS), polycarbonate-acrylonitrile-butadiene-styrene (PC/ABS) and polycarbonate (PC). Each of these materials are etched by blends of chromic and sulfuric acid to some extent leaving a narrow window of operation for getting full plating where desired and no plating where not desired at the same time; and (2) Due to the inclusion of chromic acid, the etching solution is very objectionable from environmental, health and safety perspectives.

Thus, it would be desirable to provide a means of selectively plating on plastics, including acrylonitrile-butadiene-styrene and acrylonitrile-butadiene styrene/polycarbonate resins that does not require the use of a chromic acid etchant.

Surface modification of polymers, such as sulfonation, has been used for improving polymer properties by changing the hydrophobic surfaces to hydrophilic surfaces. Sulfonation has been achieved using several methods including treatment with vapor phase sulfur trioxide, hot concentrated sulfuric acid, and fuming sulfuric acid, among others. Sulfonation alters the chemical structure of a polymeric substrate by introducing sulfonic groups on its surface region. The process of treating the surface region with sulfur trioxide gas and various neutralization agents to modify the molecular structure of the surface region of the plastic can be effective on a wide variety of polymers. Sulfonation has been suggested for use in activating the surface of a molded plastic article to accept a silane coating material thereon, as discussed for example in U.S. Pat. No. 5,958,509 to Neumann et al., the subject matter of which is herein incorporated by reference in its entirety In the sulfonation process, $SO_3$ bonds to the carbon atoms present in the polymers and forms C—$SO_3$H. This a process generally described as the sulfur atom (S) bonding to the carbon atom (C) in the carbon backbone of the polymer. Essentially all commercially available plastics and films contain either a CH or an NH bond and are treatable via sulfonation, although the inventors of the present invention have found that sulfonation proceeds at different rates depending on the particular polymer resin being sulfonated. For NH containing materials, $NSO_3H$, results as opposed to C—$SO_3$H.

The present invention relates generally to the sulfonation of molded articles having a first portion that is receptive to electroless plating thereon and a second portion which substantially inhibits electroless plating thereon. More particularly, the present invention relates to processes for forming molded blanks for printed circuit boards and molded articles and plating portions of the articles which are made with two separate molding steps to form plateable and unplateable portions of the articles.

SUMMARY OF THE INVENTION

It is an object of the present invention to provide a process for selective metallization of a molded article that minimizes or eliminates metal adherence to the non-plateable portion of the molded article.

It is another object of the present invention to provide a plateable plastic article without the use of a chromic acid/sulfuric acid etching step.

It is another object of the present invention to provide a process for electroless plating that includes a sulfonation step in order to selectively plate the molded plastic article.

To that end the present invention relates generally to a method of selectively plating a plastic article comprising a first polymer resin portion and a second polymer resin portion, wherein said first polymer resin portion is not rendered plateable by sulfonation and said second polymer resin portion is rendered plateable by sulfonation, the method comprising the steps of:

a) sulfonating the plastic article, wherein the second polymer resin portion is rendered plateable by sulfonation;
b) activating the sulfonated plastic article to accept electroless plating thereon
c) plating the sulfonated and activated article in an electroless plating bath;

whereby the plastic article is selectively plated such that the first polymer resin portion does not have plating thereon and the second polymer resin portion is electrolessly plated.

DETAILED DESCRIPTION OF THE PREFERRED EMBODIMENTS

The present invention relates generally to the use of a sulfonation step on a plastic article to render portions of the plastic article plateable. Sulfonation makes certain polymers polar so that precious metal catalysts in the catalyzing step can be made to adhere to the polymer surface.

The inventors of the present invention have found that because sulfonation of different polymer resins occurs at different rates under the same conditions, there is some degree of selectivity of sulfonation on an article made from multiple polymer resins. In particular, the inventors of the present invention have found that while ABS and PC/ABS can be sufficiently sulfonated for plating purposes very readily, polycarbonate is relatively very difficult and slow to sulfonate. Therefore, the present invention relates to the use of sulfonation to render portions of a double-shot or multiple-shot molded plastic article plateable while the remaining portions are not plateable so that the article can be selectively plated in a desired pattern.

Articles formed by double-shot injection molding, where one shot is PC/ABS and the other shot is PC can be subjected to a sulfonation process sufficient to render the PC/ABS portion plateable but not the PC shot. These parts are then processed through various electroless plating processing steps including, for example, a precious metal catalyst solution, followed by a catalyst reducing solution, followed by electroless copper or electroless nickel plating. Electroless metal can be easily and reliably deposited on the PC/ABS or ABS polymer resin surface, but no deposition on the polycarbonate areas occurs.

In order to prevent any electroless metal from plating onto the non-plateable portions, a catalytic poison compound can be included in the non-plateable resin to retard the tendency of subsequently applied electroless plating chemistry to create a plated deposit on that portion containing the catalytic poison compound. The double shot molded plastic part can then be processed through a standard plating-on-plastic process line that utilizes colloidal activation, acceleration, and then subjected to electroless copper or electroless nickel plating chemistry. As discussed above, by using the sulfonation step of the present invention, the chromic acid/sulfuric acid etching step and a subsequent neutralization step can be eliminated. Other plating-on-plastic processes known in the art may also be used in the practice of the invention.

In one embodiment, the process of the invention relates to a method of selectively plating a plastic article comprising a first polymer resin portion and a second polymer resin portion, wherein said first polymer resin portion is not rendered plateable by sulfonation and said second polymer resin portion is rendered plateable by sulfonation, the method comprising the steps of:

a) sulfonating the plastic article, wherein the second polymer resin portion is rendered plateable by sulfonation;
b) activating the sulfonated plastic article to accept electroless plating thereon
c) plating the sulfonated and activated article in an electroless plating bath;

whereby the plastic article is selectively plated such that the first polymer resin portion does not have plating thereon and the second polymer resin portion is electrolessly plated.

The use of sulfonation as described herein allows a mixed resin double- or multiple-shot resin article, to be selectively plated within a wide process window without the use of chromic acid. The sulfonation can be accomplished by exposing the article to fuming sulfur acid or vapor phase sulfur trioxide, by way of example and not limitation.

In one embodiment of the invention, vapor phase sulfur trioxide is preferred. The sulfonation step is typically accomplished by conditioning the plastic article in a sulfur atmosphere at a concentration and period of time sufficient to sulfonate the second polymer resin portion of the article. The concentration of the sulfonation agent in the sulfur atmosphere is typically in the range of about 1% to about 25% by weight, depending on the specific sulfur agent used. In addition, the time period for sulfonation is typically in the range of about 1 to about 90.

The dual-shot injection molding process forms first and second "shots" respectively from one and then the other of a non-plateable polymer and a plateable polymer that together comprise the plastic part. The two portions are forced, under pressure into a closed mold or molds and the materials solidify within the mold cavity. The molded material retains the shape of the mold, and the finished molded part is then ejected from the mold cavity. For example, in forming the molded article for adherent metallization, such as a printed circuit board with a circuit pattern, the two shot injection molding process forms the circuit pattern with the first shot and forms the support structure around the circuit pattern with the second shot. Other two-shot and multiple-shot molding processes are also usable in the practice of the invention.

After being processed through the steps of sulfonation and the plating-on-plastic line (activation and electroless plating), only one portion of the molded part becomes receptive to electroless plating while the other portion does not. The innovative process described herein also eliminates the need for the objectionable chromic acid/sulfuric acid etching step.

The result is a molded plastic part that exhibits improved plating quality and reduced plating scrap and also solves an industry problem regarding extraneous plating of double shot molded pieces.

As discussed above, the double-shot molded piece comprises a plating portion and a non-plating portion. Other suitable combinations of resin in the plating portion and the non-plating portion would also be known to those skilled in the art.

In order to prepare the plateable plastic portion for electroless plating thereon, the plastic part is processed through one of several typical electroless plating cycles (plating on plastic cycles). Various electroless plating (plating on plastic) cycles are known and may be used in the present invention. Several of these cycles are set forth below and are given by way of example and not limitation.

In one embodiment, following sulfonation of the resin, the electroless plating cycle includes the following steps:

1) Colloidal activation;
2) Acceleration; and
3) Electroless nickel or copper plating.

Cold water rinses are typically interposed between each of the steps of the process.

In another embodiment, following sulfonation, the electroless plating cycle includes the following steps:

1) Ionic palladium activation (acid or alkaline);
2) Ionic reducer, hypophosphite, dimethylaminoborane (DMAB) or borohydride mixture in water; and
3) Electroless nickel or copper plating.

In still another embodiment, following sulfonation, the electroless plating cycle includes the following steps:

1) Ionic palladium activation;
2) Ionic palladium reducer; and
3) Electroless nickel or copper plating.

Other electroless plating processes known in the art would also be suitable for use in the present invention.

While the invention has been described above with reference to specific embodiments thereof, it is apparent that many changes, modifications, and variations can be made without departing from the inventive concept disclosed here. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A method of selectively plating a plastic article comprising a first polymer resin portion and a second polymer resin portion, wherein said first polymer resin portion is not rendered plateable by sulfonation and said second polymer resin portion is rendered plateable by sulfonation, the method comprising the steps of:

a) contacting the first polymer resin portion and the second polymer resin portion of the plastic article with a sulfonating agent, wherein the second polymer resin portion is rendered plateable by sulfonation;

b) contacting the sulfonated plastic article with an activating agent comprising ionic palladium followed by an ionic palladium reducer so as to accept electroless plating thereon;

plating the sulfonated and activated plastic article in an electroless plating bath;

wherein the first polymer resin portion comprises a catalytic poison compound;

wherein the first polymer resin portion comprises a different polymer from the second polymer resin portion; and whereby the plastic article is selectively plated such that the first polymer resin portion does not have plating thereon and the second polymer resin portion is electrolessly plated.

2. The method according to claim 1, wherein the first polymer resin portion comprises polycarbonate resin.

3. The method according to claim 2, wherein the second polymer resin portion comprises acrylonitrile-butadiene-styrene (ABS) resin or ABS/polycarbonate resin.

4. The method according to claim 1, wherein the electroless plating bath comprises electroless copper or electroless nickel.

5. The method according to claim 1, wherein the plastic article is formed by double-shot molding in which the first polymer resin portion and the second polymer resin portion are forced under pressure into a closed mold or molds and the materials solidify within the mold cavity.

6. The method according to claim 1, wherein the plastic article is selectively plated without using a chromic acid/sulfuric acid etching step.

7. The method according to claim 1, wherein the sulfonation agent comprises fuming sulfuric acid or vapor phase sulfur trioxide.

8. The method according to claim 7, wherein the sulfonating agent comprises vapor phase sulfur trioxide.

* * * * *